United States Patent [19]

Nakamura et al.

[11] 4,111,175

[45] Sep. 5, 1978

[54] APPARATUS FOR PREVENTING AFTERBURNING IN AN INTERNAL COMBUSTION ENGINE

[75] Inventors: Norihiko Nakamura, Mishima; Takahide Kawamura, Toyota, both of Japan

[73] Assignee: Toyota Jidosha Kogyo Kabushiki Kaisha, Japan

[21] Appl. No.: 693,626

[22] Filed: Jun. 7, 1976

[30] Foreign Application Priority Data

Oct. 29, 1975 [JP] Japan ..... 50-129365
Feb. 4, 1976 [JP] Japan ..... 51-010261

[51] Int. Cl.[2] ..... F02B 77/00

[52] U.S. Cl. ..... 123/198 DC; 123/DIG. 11; 123/148 S

[58] Field of Search ... 123/198 D, 198 DC, DIG. 11, 123/148 S

[56] References Cited

U.S. PATENT DOCUMENTS

| | | | |
|---|---|---|---|
| 3,116,729 | 1/1964 | Crowe | 123/198 DC X |
| 3,158,144 | 11/1964 | Walker | 123/198 DC |
| 3,241,539 | 3/1966 | Kuehn | 123/198 DC |
| 3,251,352 | 5/1966 | Walker | 123/148 |
| 3,601,103 | 8/1971 | Swiden | 123/198 DC X |
| 3,680,539 | 8/1972 | Savage et al. | 123/198 DC X |
| 3,726,265 | 4/1973 | Howard | 123/198 DC X |
| 3,914,735 | 10/1975 | Guillaume | 123/198 D X |

*Primary Examiner*—Charles J. Myhre
*Assistant Examiner*—Ira S. Lazarus
*Attorney, Agent, or Firm*—Stevens, Davis, Miller & Mosher

[57] ABSTRACT

An apparatus for preventing afterburning in an internal combustion engine having an ignition circuit, an ignition switch and a battery, and including an engine rotation detecting circuit for detecting the rotational speed of the engine above a predetermined level, a switching circuit actuated in response to the engine rotation detecting circuit which continues to energize the ignition circuit from the battery even after the ignition switch is turned off as long as the engine rotates at a speed above the predetermined level, and a timer circuit which cuts off the ignition circuit from the battery regardless of the condition of the switching circuit a predetermined time after the ignition switch is turned off.

10 Claims, 6 Drawing Figures

APPARATUS FOR PREVENTING AFTERBURNING IN AN INTERNAL COMBUSTION ENGINE

BACKGROUND OF THE INVENTION

This invention relates to an internal combustion engine and more particularly to an apparatus for preventing the explosive combustion of unburnt gas transferred into the exhaust system after the ignition switch of the engine has been turned off.

Even when the ignition switch is turned off, an engine cannot stop its rotational movement immediately due to inertial rotating forces. Fuel sucked from the carburetor during this inertial rotation period is introduced, still unburnt, through the cylinders into the exhaust system where it produces explosive combustion. This explosive combustion of the unburnt gas in the exhaust system is known as "afterburning".

Recently, air pollution caused by exhaust gases from internal combustion engines has become a serious problem. Increasingly, the trend is to use engines in which the exhaust systems are provided with a reactor that purifies the exhaust emissions by re-combusting hydrocarbons (HC) and carbon monoxide (CO) contained in these emissions. It has been found, however, that afterburning occurs in the reactor, which has frequently led to such serious troubles as damage to or breakdown of the muffler or other parts of the exhaust system.

In order to reduce the output of nitrogen oxides (NOx) that are present in exhaust gases together with other noxious substances, some engines are designed or adjusted to burn lean air-fuel mixtures. But in such lean mixture combustion systems, the air-fuel mixture transferred unburnt to the exhaust system of the engine during the inertial rotation period can also cause explosive combustion. Thus the afterburning phenomenon has been a severe problem for the lean mixture combustion systems as well.

There is a known method to prevent afterburning that continues igniting the mixture during the inertial rotation of the engine when the engine rotates above a predetermined speed after the turning off of the ignition switch. This method, however, has a disadvantage in that it causes the inertial rotation period to increase, and, in the extreme case, the engine may continue to "diesel" for a considerable length of time.

SUMMARY OF THE INVENTION

The object of this invention is to provide an apparatus that effectively prevents afterburning and overcomes the shortcomings of previous systems.

In this invention, the spark plug or plugs are ignited during the inertial rotation period of the engine when the engine rotates above a predetermined speed for a predetermined time interval established by a timer circuit after the main ignition switch has been turned off. This prevents unburnt gas from being passed to the exhaust system and the inertial rotation period is reduced to stop the engine quickly. In addition, the "dieseling" effect is avoided.

BRIEF DESCRIPTION OF THE DRAWING

This invention will be described in detail with reference to the accompanying drawings, in which.

DESCRIPTION OF THE PREFERRED EMBODIMENT

Figure 1:
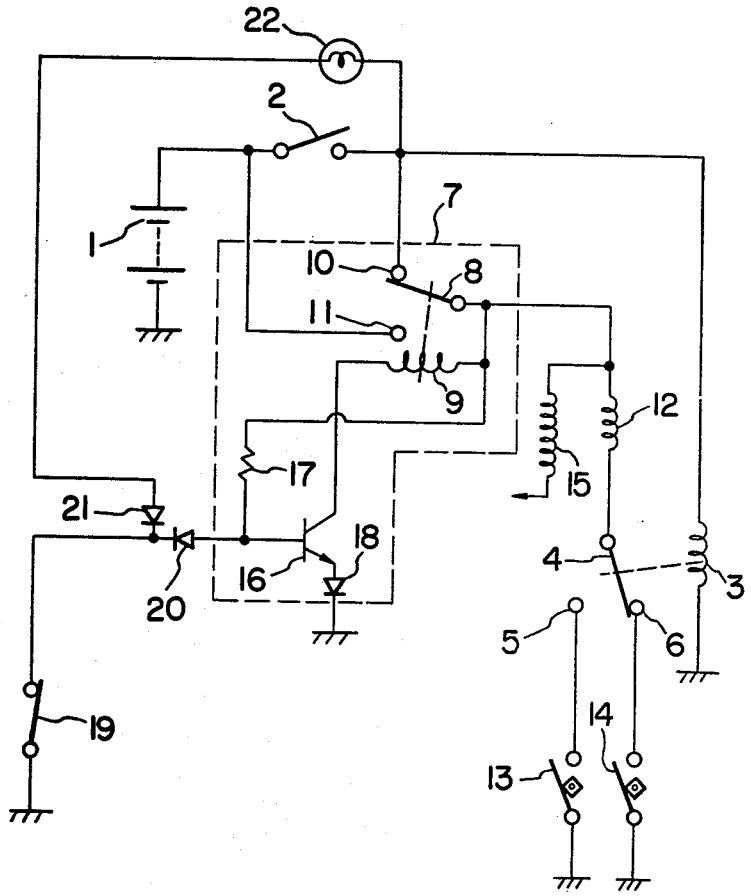
FIG. 1 is a circuit diagram showing a first embodiment of this invention.

In the first embodiment (FIG. 1), a battery 1 is connected through an ignition switch 2 to an ignition timing switching solenoid coil 3. The solenoid coil 3 operates a switch member 4 that selectively engages contacts 5 or 6. When the solenoid 3 is de-energized, switch member 4 normally engages contact 6 (as shown). A circuit 7 detects the rotation of the engine and switches the power source for the ignition system through a switch 8 actuated by a solenoid coil 9 to make contact with one or the other of contacts 10 and 11. Switch member 8 engages contact 10 when solenoid 9 is de-energized (as shown). A primary ignition coil 12 has one end connected to switch 8 and the other end connected to switch 4. Normal ignition timing distributor point 13 is connected between contact 5 and ground and delayed ignition timing distributor point 14 is connected between contact 6 and ground. A secondary ignition coil 15 is connected to primary coil 12 to provide the high voltage spark source. The base of a transistor 16 is connected to the switch 8 through a resistor 17; the collector of transistor 16 is connected directly to solenoid coil 9. The emitter of transistor 16 is grounded through a diode 18.

An oil pressure detecting switch 19 is connected to the base of transistor 16 through a diode 20, and to the switch 8 through a diode 21 and an oil pressure warning lamp 22. Switch 19 opens when the oil pressure is raised due to engine rotation and closes when the oil pressure is reduced to or close to zero upon the engine being stopped. The pressure level at which this on-off operation takes place may be established suitably. The oil pressure warning lamp 22 becomes lit when the ignition switch 2 is turned on to start the engine and stays on until oil pressure rises enough to open the oil pressure detecting switch 19. The current from the battery 1 passes through the ignition switch 2, oil pressure warning lamp 22, diode 21, and oil pressure detecting switch 19. The operation of this embodiment will be explained hereunder.

When the ignition switch 2 is closed, current from the battery 1 energizes the solenoid 3 and the switch member 4 is brought into contact with the contact 5 to provide the proper ignition timing through distributor point 13 to start the engine. Initially, the oil pressure is zero; thus the oil pressure detecting switch 19 is closed (as shown) and the base of transistor 16 is grounded. Accordingly, the transistor 16 is biased off. As the engine starts and its rotation exceeds a predetermined level, the oil pressure rises enough to open the oil pressure detecting switch 19. Then, the transistor 16 is biased on, permitting current to flow through the solenoid 9. As a consequence, switch 8, normally in contact with contact 10, is shifted into contact with the contact 11. This action effects no change with regard to current flowing through primary ignition coil 12, distributor points 13 and secondary coil 15.

Upon opening the ignition switch 2 to shut off the engine, the solenoid 3 becomes de-energized and switch 4 returns to its normal position in contact with contact 6. At this point, the engine is still rotating due to inertia; during this period ignition will continue with the delayed timing provided by the point 14. Also during the inertial rotation period of the engine, oil pressure does not drop significantly so that the oil pressure detecting switch 19 remains open; thus transistor 16 continues to conduct and solenoid 9 remains energized.

By delaying the ignition timing during the inertial rotation period of the engine, the engine torque in the explosion and combustion stroke is so low that its output is decreased, which in turn further attenuates its inertial rotation. As the inertial rotation force of the engine approaches zero, oil pressure drops to a point where the oil pressure detecting switch 19 closes. This action causes the base of transistor 16 to be grounded, thereby biasing transistor 16 off. This de-energizes the solenoid 9, whereby the change-over switch 8 returns to its normal state in contact with contact 10. As a result, power supply from the battery 1 to the entire circuit, including the ignition coil 15, is cut off.

In a modified form of the first embodiment (FIG. 1A), the collector of transistor 16 is connected to solenoid 9 through a switch 48 of a timing circuit 47. Timer circuit 47 further includes a solenoid 49 that actuates switch 48 to open or close the connection between transistor 16 and solenoid 9, a series connected capacitor 50 and resistor **50*a* provided in parallel with solenoid 49, and a diode 51 connected to battery 1 through ignition switch 2**.

When the ignition switch 2 is turned on, the solenoid 49 is energized to close the switch 48. At the same time, capacitor 50 charges through resistor **50*a* and diode 51. All other operations are as described above with respect to FIG. 1**.

When the ignition switch 2 is opened, the current supply to solenoid 49 from battery 1 is cut off. Solenoid 49 remains energized as a result of the charge stored in capacitor 50 to keep the switch 48 in the closed position. As long as the engine continues to rotate due to inertia, the oil pressure will not drop significantly and switch 19 remains open to keep transistor 16 biased on.

Occasionally, the inertial rotation force does not attenuate as rapidly as desired. On such occasions, the solenoid 49 is de-energized after a time delay determined by the RC time constant of capacitor 50 and resistor **50*a* in the timer circuit 47. Switch 48 then opens, thereby breaking the current path from battery 1, through contact 11, switch 8, solenoid 9 and transistor 16. Solenoid 9 is thus de-energized, cutting the current path to ignition coil 12, regardless of the position of switch 19. It will be seen that incorporation of the time delay circuit 47** frees the ignition cut-off control from complete dependence on an engine operating parameter.

Figure 1A:
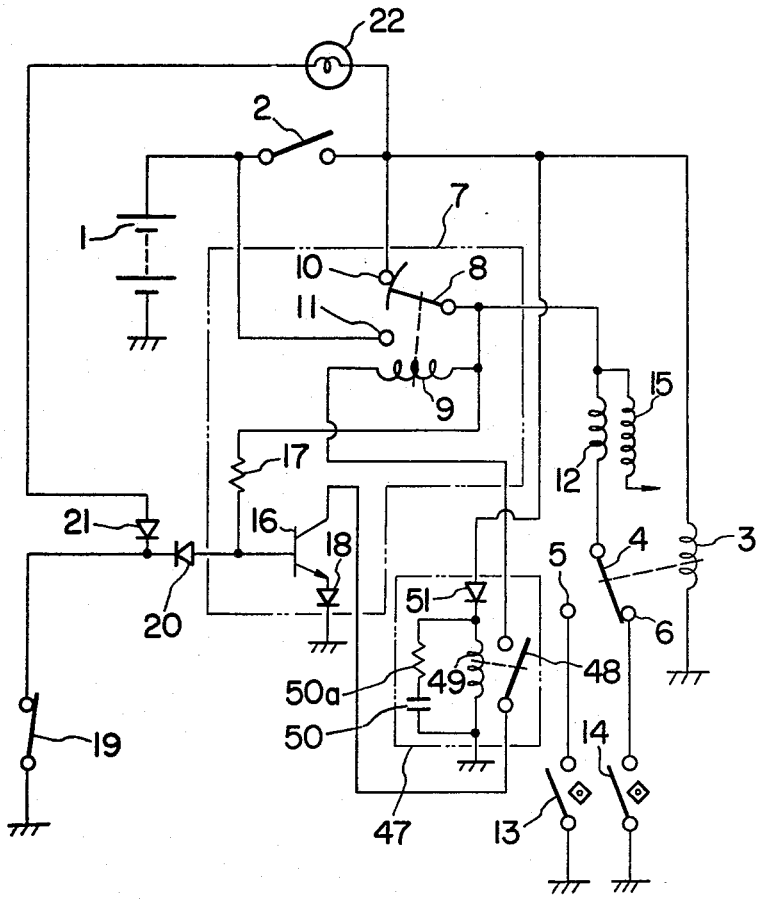
FIG. 1A shows a modified form of the first embodiment.
Figure 2:
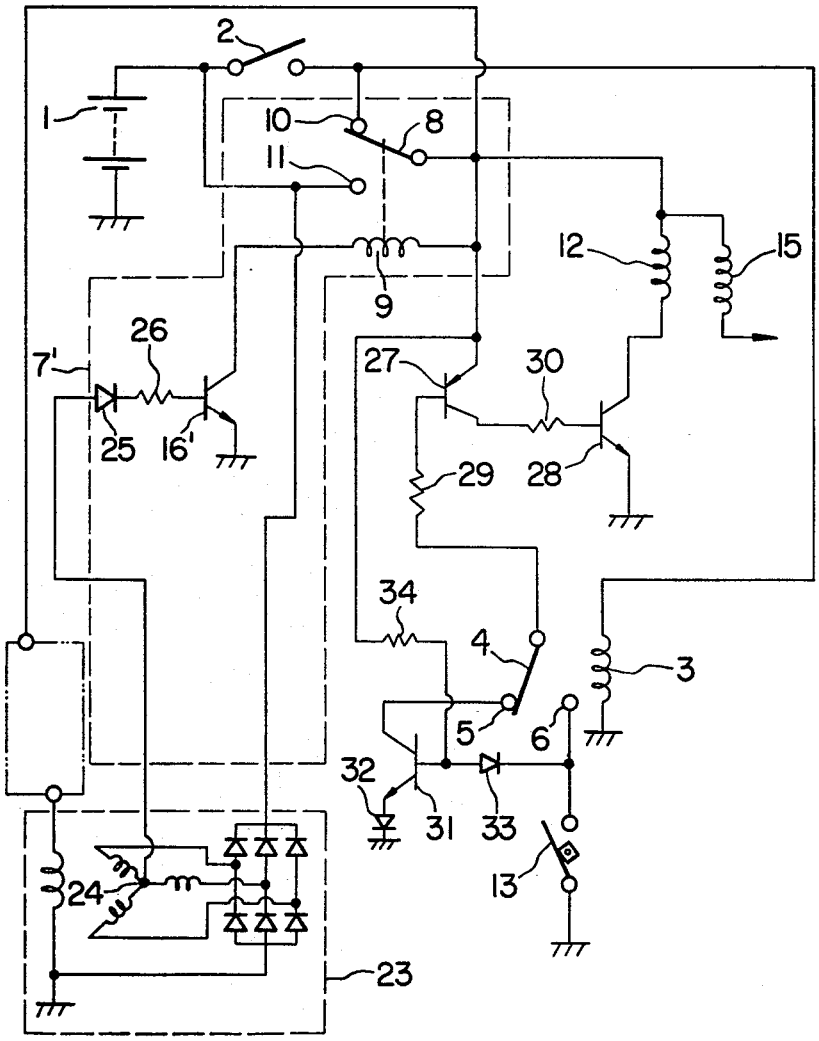
FIG. 2 is a circuit diagram of a second embodiment of this invention.

In a second embodiment (FIG. 2), the neutral voltage of the generator is utilized as a means for detecting the rotation of the engine, and the ignition delay is accomplished by reversing the ignition timing as controlled by the distributor point 13. In FIG. 2, elements corresponding to and having similar functions as those shown in FIG. 1 are designated by the same reference numerals and a detailed description of these corresponding elements is omitted. A circuit 7' detects the rotation of the engine and switches the power source for the ignition system. Circuit 7' includes a transistor 16', the base of which is connected through a diode 25 and a resistor 26 to the neutral point 24 of a generator 23. The collector of transistor 16' is connected to the solenoid 9, while its emitter is grounded. A transistor 27 has its emitter connected to the switch 8, its base to the switch 4 through a resistor 29, and its collector to the base of a transistor 28 through a resistor 30. The collector of transistor 28 is connected to the switch 8 through the primary ignition coil 12, and its emitter is grounded. Delayed timing distributor point 14 (FIG. 1) is replaced by a transistor 31 having its collector connected to the contact 5 and emitter grounded through a diode 32. The base of transistor 31 is connected to the contact 6 through a diode 33, and to the switch 8 through a resistor 34.

The operation of this second embodiment is as follows:

When the ignition switch 2 is closed, the current from the battery 1 energizes solenoid 3 to connect the switch 4 with the contact 6. At this time, voltage at the neutral point 24 is still zero; thus the transistor 16' is biased off, the solenoid 9 is not energized, and the switch 8 remains in contact with the contact 10. As the engine starts to rotate, the distributor point 13 alternately closes and opens a current path between the base of transistor 27 and ground, whereby the transistor 27 intermittently turns on and off, respectively, which in turn biases transistor 28 on and off. The intermittent on-off operation of the transistor 28 generates current surges through the primary ignition coil 12, thereby producing a high voltage in the secondary coil 15 which feeds the spark plugs (not shown) in a conventional manner. At this time, the ignition timing is normal, and the engine starts to rotate gradually. As the voltage at the neutral point 24 of the generator 23 rises, current flows through the diode 25 and resistor 26 to bias transistor 16' to its on state. This completes a current path to energize the solenoid 9, and move the switch 8 into contact with the contact 11. As with the first embodiment, this action does not affect the operation of the ignition system.

When the ignition switch 2 is opened, the solenoid 3 is de-energized to return switch 4 to its normal position (shown) in contact with contact 5. Then, as the distributor point 13 opens and closes intermittently, the transistors 31, 27 and 28 are all turned on and off (i.e. rendered conductive and non-conductive), respectively.

Here, the disconnection of distributor point 13 turns on the transistors 31, 27 and 28 to pass current to the primary ignition coil 12. That is, when the ignition switch is open, production of high voltage in the secondary coil 15 due to the intermittent connection of the distributor point 13 is phase reversed as compared with the ignition switch being closed, where current flows to the primary ignition coil 12 when the distributor point 13 is closed. Consequently, the ignition timing when switch 2 is open is delayed from the timing when switch 2 is closed by an angle of a certain degree which is defined by the engine type, the number of cylinder and the dwell angle of the distributor etc., above all, which is defined mainly by the dwell angle of the distributor.

As subsequent inertial rotation of the engine slows down to zero, the voltage at the neutral point 24 drops and the transistor 16' is biased off. Therefore, the solenoid 9 is de-energized to return switch 8 to its normal position (as shown) in contact with the contact 10, and cutting off the current supply to primary ignition coil 12.

Figure 2A:
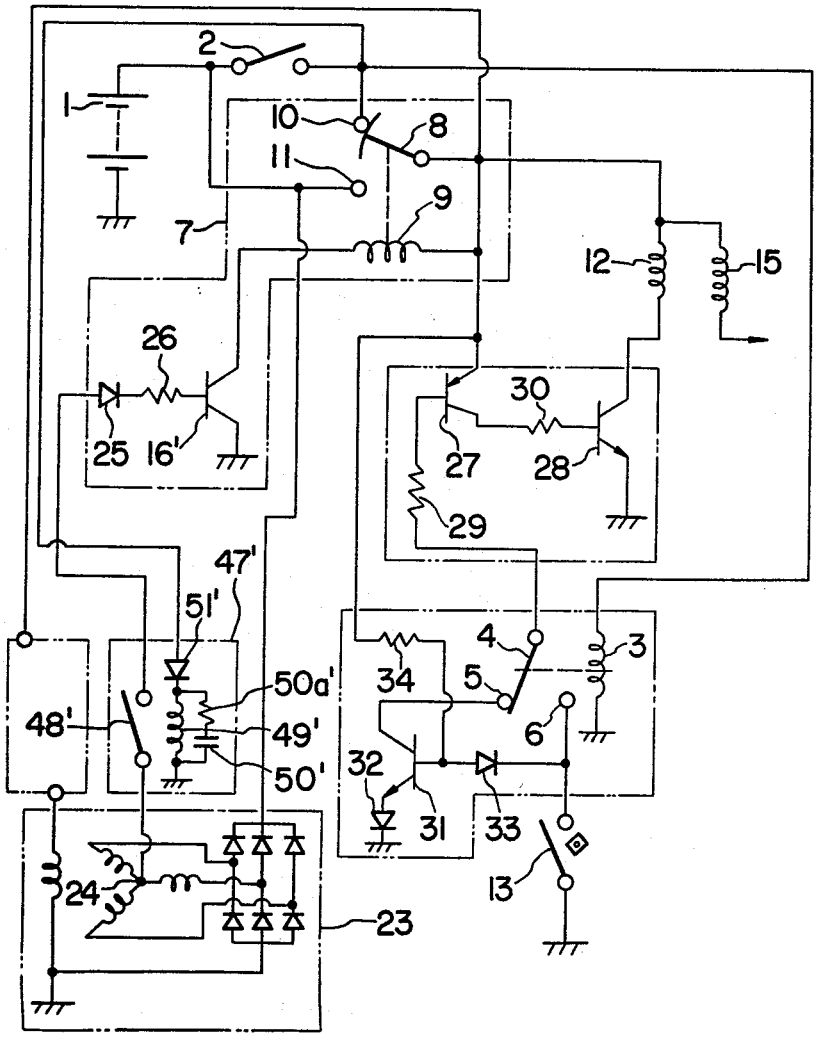
FIG. 2A shows a modified form of the second embodiment.

In a modified version of the second embodiment (FIG. 2A), a time delay circuit 47′ is interposed between diode 25 and neutral point 24. Delay circuit 47′ is substantially identical in construction and operation to the delay circuit 47 (FIG. 1A) described above.

Figure 3:
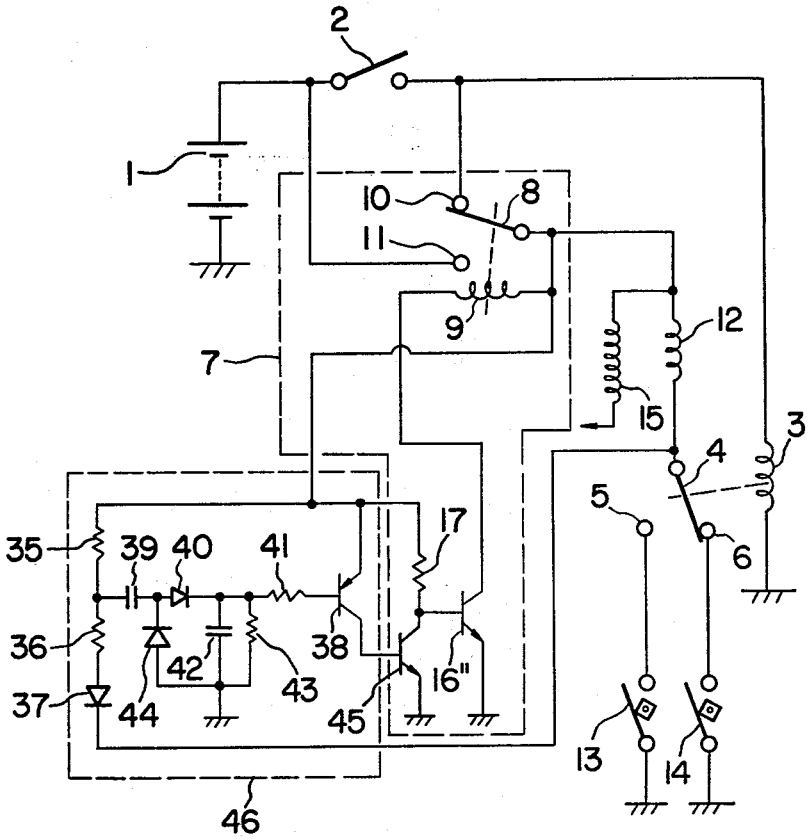
FIG. 3 is a circuit diagram showing a third embodiment of this invention.

In the third embodiment (FIG. 3), a circuit that generates a charging voltage proportional to the frequency of the intermittent connection of the distributor point, which is representative of the rotational speed of the engine, is utilized as a circuit for detecting engine rotation and switching the ignition system power source. In FIG. 3, elements corresponding to and having similar functions to those shown in FIG. 1, are designated by the same reference numerals and a detailed description of these corresponding elements will be omitted.

In this embodiment, switches 4 and 8 are connected with each other through resistors 35 and 36 and a diode 37, which form part of a charging circuit 46. This charging circuit also comprises a transistor 38 whose emitter is connected to the switch 8, and its base to the junction of resistors 35 and 36 through a capacitor 39, a diode 40 and a resistor 41. A capacitor 42, a resistor 43, and a diode 44 comprise a charge storage circuit having a discharge rate determined by the RC time constant of capacitor 42 and resistor 43. A transistor 45 has a base connected to the collector of transistor 38, a grounded emitter, and a collector which is connected directly to the base of transistor 16″ and through resistor 17 to the switch 8. The voltage applied to charge capacitor 42 increases proportionally with an increase in the frequency of intermittent connection of the distributor points 13 and 14, that is, as the speed of rotation of the engine increases.

When ignition switch 2 is closed, this embodiment operates in the same manner as the embodiment of FIG. 1; therefore a description of its operation will be limited to the inertial rotation period of the engine, i.e., after ignition switch 2 is opened.

During the inertial rotation period, the charging voltage across capacitor 42 is high and the transistors 38 and 45 are biased off, while the transistor 16″ is biased on. Accordingly, the solenoid 9 remains energized to connect switch 8 to the contact 11, and ignition is controlled by the delayed ignition timing point 14. (Solenoid 3 was de-energized by the opening of switch 2, thereby returning switch 4 into contact with contact 6.)

As the inertial rotation force approaches zero, the charging voltage across capacitor 42 drops and transistors 38 and 45 are biased on. As a consequence, transistor 16″ is biased off, the solenoid 9 is de-energized, and switch 8 returns to the position shown in contact with contact 10, thereby cutting off the current supply to primary ignition coil 12.

Figure 3A:
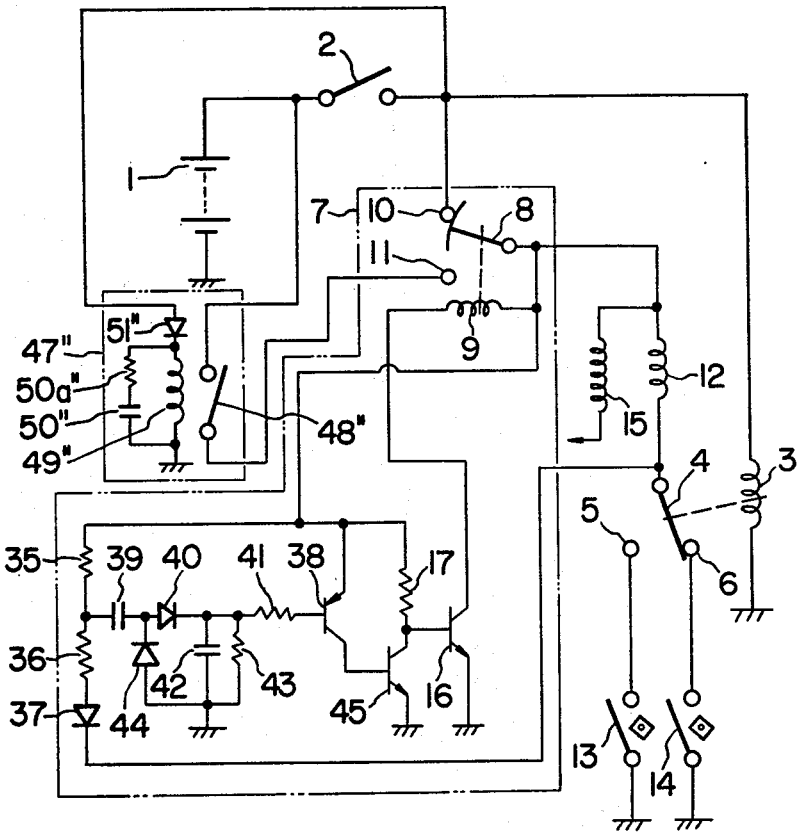
FIG. 3A shows a modified form of the third embodiment.

In a modified version of the third embodiment (FIG. 3A), a switch 48″ of a time delay circuit 47″ is interposed between battery 1 and contact 11. Delay circuit 47″ is substantially identical in construction and operation with the delay circuit 47 (FIG. 1A) described above.

According to this invention, as described above, ignition during the inertial rotation period of the engine is achieved by delaying the ignition timing. This reduces the torque produced, attenuates the inertial rotation of the engine faster, and therefore eliminates the problem that the inertial rotation of the engine continues without stopping as has been experienced with conventional afterburning preventing apparatus.

Although this invention has been described above with respect to negative ground systems, it is apparent that it is equally applicable to positive ground systems, requiring only obvious modifications to the circuit devices.

Although the principles of the present invention have been described above in relation to a particular embodiment, it will be understood that said description has been provided merely by way of example and that the scope of the invention is not limited thereby.

What is claimed is:

1. Apparatus for substantially preventing afterburning of unburnt combustion products in an internal combustion engine having a source of electrical energy and an ignition circuit for generating high voltage pulses coupled to said electrical energy source, said apparatus comprising:

an ignition switch interposed between said source and said ignition circuit and movable between closed and open positions;

means coupled with said ignition switch and said ignition circuit for selecting a first ignition timing sequence when said ignition switch is closed and a second ignition timing sequence when said ignition switch is opened, wherein said second ignition timing sequence is delayed a predetermined amount with respect to said first ignition timing sequence;

means for detecting an engine operating parameter directly related to the rotational speed of said engine; and means coupled with said detecting means, said ignition circuit and said energy source for maintaining a closed circuit between said ignition circuit and said energy source during said second timing sequence until said engine operating parameter reaches a predetermined value, and thereafter opening said closed circuit to prevent further ignition pulses from being generated by said ignition circuit.

2. The apparatus according to claim 1, wherein said means for maintaining a closed circuit comprises a relay having a coil, switch means coupled to said coil and said detecting means for energizing said coil when the detected value of said engine operating parameter is higher than said predetermined value and for de-energizing said coil when the detected value of said engine operating parameter is lower than said predetermined value, a pair of relay contacts, and a switch member coupled to said coil and to said ignition circuit and movable between said pair of contacts, one of said pair of contacts being coupled directly to said energy source and the other of said pair of contacts being coupled to said energy source through said interposed ignition switch.

3. The apparatus according to claim 2, wherein said ignition timing sequence selecting means comprises a second relay having a coil coupled to said ignition switch, first and second relay contacts, and a switch member coupled to said ignition circuit and movable between said first and second relay contacts; said ignition timing sequence selecting means comprising a first distributor point coupled to said first relay contact for controlling the timing of high voltage pulses generated by said ignition circuit during said first timing sequence, and a second distributor point coupled to said second relay contact for controlling the timing of high voltage pulses generated by said ignition circuit during said second timing sequence.

4. The apparatus according to claim 2, wherein said switch means coupled to said coil and said detecting means comprises a three-terminal solid state device having one terminal coupled to ground, a second terminal coupled to said coil and a control terminal coupled to said detecting means, said three-terminal device being rendered conductive or nonconductive as a function of a voltage representing the detected value of said engine operating parameter.

5. The apparatus according to claim 4, wherein said detecting means comprises means for detecting the oil pressure level in said engine coupled to said control terminal of said three-terminal device to thereby cause said three-terminal device to conduct when the oil pressure level increases with increasing engine speed above a predetermined value and to cause said three-terminal device to become nonconductive when said oil pressure level drops with decreasing engine speed below said predetermined level.

6. The apparatus according to claim 4, wherein said detecting means comprises a voltage generator coupled to and driven by said engine and means coupling said control terminal of said three-terminal device to the neutral terminal of said voltage generator to thereby cause said three-terminal device to conduct when the voltage at said neutral terminal increases with increasing engine speed above a predetermined cut-off value and to cause said three-terminal device to become nonconductive when said voltage at said neutral terminal decreases with decreasing engine speed to below said predetermined cut-off value.

7. The apparatus according to claim 4, wherein said detecting means comprises a storage circuit coupled to said ignition circuit for storing a voltage directly proportional to the frequency of voltage pulses generated by said ignition circuit, and means for discharging the voltage stored in said storage circuit through said three-terminal device at a predetermined rate of decay after said ignition switch is opened.

8. The apparatus according to claim 4, further comprising timer means coupled with said ignition circuit and said energy source for maintaining a closed circuit between said ignition circuit and said energy source for a predetermined time after said ignition switch is opened and during said second ignition timing sequence, and thereafter opening said closed circuit to prevent further ignition pulses from being generated by said ignition circuit.

9. The apparatus according to claim 2, wherein said ignition timing sequence selecting means comprising:

a distributor point for controlling the timing of high voltage pulses generated by said ignition circuit;

delay circuit means coupled to said distributor point for delaying the timing sequence of said distributor point by an angle of a certain degree which is defined by the engine type, the number of cylinder and the dwell angle of the distributor etc., above all, which is defined mainly by the dwell angle of the distributor; and means for selectively coupling said ignition circuit to said distributor point directly or through said delay circuit means, depending on whether said ignition switch is closed or open, respectively.

10. Apparatus for substantially preventing afterburning of unburnt combustion products in an internal combustion engine having a source of electrical energy and an ignition circuit for generating high voltage pulses coupled to said electrical energy source, said apparatus comprising:

an ignition switch interposed between said source and said ignition circuit and movable between closed and open positions;

means coupled with said ignition switch and said ignition circuit for selecting a first ignition timing sequence when said ignition switch is closed and a second ignition timing sequence when said ignition switch is opened, wherein said second ignition timing sequence is delayed a predetermined amount with respect to said first ignition timing sequence; and means coupled with said ignition circuit and said energy source for maintaining a closed circuit between said ignition circuit and said energy source for a predetermined time after said ignition switch is opened and during said second ignition timing sequence, and thereafter opening said closed circuit to prevent further ignition pulses from being generated by said ignition circuit.

* * * * *